United States Patent [19]

Seto

[11] Patent Number: 4,726,305

[45] Date of Patent: Feb. 23, 1988

[54] THREAD CUTTING DEVICE FOR CYLINDER BED SEWING MACHINE

[75] Inventor: Yoji Seto, Osaka, Japan

[73] Assignee: Pegasus Sewing Machine Mfg. Co., Ltd., Japan

[21] Appl. No.: 48,430

[22] Filed: May 11, 1987

[30] Foreign Application Priority Data

Jun. 19, 1986 [JP] Japan ..... 61-143824

[51] Int. Cl.[4] ..... D05B 65/02

[52] U.S. Cl. ..... 112/298; 112/199

[58] Field of Search ..... 112/298, 296, 292, 297, 112/288, 291, 199

[56] References Cited

U.S. PATENT DOCUMENTS

| | | | |
|---|---|---|---|
| 3,386,402 | 6/1968 | Ross | 112/298 |
| 3,391,665 | 7/1968 | Kozuka | 112/296 |
| 3,403,648 | 10/1968 | Jarrett | 112/296 X |
| 3,405,622 | 10/1968 | Ross | 112/296 |
| 3,424,115 | 1/1969 | Schopf | 112/296 |
| 3,424,117 | 1/1969 | Schopf | 112/292 |
| 3,489,115 | 1/1970 | Marfario et al. . | |
| 3,605,664 | 9/1971 | Gentofte . | |
| 3,871,307 | 3/1975 | Scott et al. | 112/296 X |
| 4,098,209 | 7/1978 | Schopf | 112/298 |

FOREIGN PATENT DOCUMENTS

| | | |
|---|---|---|
| 46-9624 | 11/1971 | Japan . |
| 61-276597 | 12/1986 | Japan . |

*Primary Examiner*—H. Hampton Hunter

*Attorney, Agent, or Firm*—Jones, Tullar & Cooper

[57] ABSTRACT

A thread cutting device for a cylinder bed sewing machine for sewing by means of a plurality of needles a piece of fabric supported on a cylindrical bed while transporting the fabric piece in a given direction, wherein a hook portion of a thread catch member which is adapted to plunge into and retreat from needle thread loops in orthogonal relation to an obliquely inclined plane of opening of the needle thread loops so that a plurality of needle and looper threads are accurately caught into the hook portion and then carried along thereby for cutting. In addition, an arrangement is disclosed which enables the mounting of the thread cutting device without interferring with the movement of a looper, even if the available space within the bed is very limited.

4 Claims, 12 Drawing Figures

THREAD CUTTING DEVICE FOR CYLINDER BED SEWING MACHINE

BACKGROUND OF THE INVENTION

1. Field of the Invention

This invention relates to a thread cutting device for a cylinder bed forming seams machine for sewing by means of a plurality of needles on the pieces of fabric supported on a cylindrical bed while transporting the fabric pieces in a given direction.

Thread cutting devices of the type must have a thread cutter, and a thread catch member for catching needle thread loops formed in numbers corresponding to the number of needles and looper threads interlooped with the needle thread loops for directing them to the cutter. In cylinder bed sewing machines, however, the internal space of the bed is very limited and various components such as a looper and the like have to be housed in a limited internal space. For this reason, special consideration has been given with respect to the mounting position for the thread cutting device and the path of movement thereof.

A prior-art thread cutting device disclosed in U.S. Pat. No. 4,098,209 is shown in FIG. 10. In the FIG. 10 thread cutting device, a thread catch member 50 having dogleg-shaped slots 51, 51 is connected to a driving lever 52 so that when the lever 52 is pivotally moved from its position shown in the direction of arrow A, the thread catch member 50 is caused to move lower-leftwardly in FIG. 10 by the action of guide pins 53, 53 fitted in the slots 51, 51, being then allowed to move linearly in the leftward direction. A support member 55 having a slot 54 is urged leftward by a resilient member means 56, so that when the thread catch member 50 is moved lower-leftwardly, the support member 55 is actuated by the thread catch member 50 to move in the lower-leftward direction until it goes into abutment with a stopper 57. When the thread catch member 50 is in linear movement as aforesaid, the support member 55 is on standby as it is in abutment with the stopper 57, so that as the thread catch member 50 turns back with needle thread and looper thread (not shown) caught thereinto, the caught-up threads are cut by a thread cutter 58 provided at the front end of the support member 55.

As FIG. 12 illustrates, a straight line path $X_1$ along which the thread catch member 50 is linearly moved is in orthogonal relation to the direction Y of fabric feed during sewing operation, and the starting point S of a path $X_2$ which the thread catch member 50 follows when it is in lower-leftward movement is located away from an extension of the straight line path $X_1$ so that the catch member 50 may not interfere with the movement of a looper 59 shown in FIG. 11.

The looper 59, as shown in FIG. 11, is caused to move toward and away from the straight line path $X_1$ (see FIG. 12), along which the thread catch member 50 moves, while being inclined at an angle of $\theta$ relative to the path $X_1$, and accordingly, when the movement of the looper 59 is stopped at a left dead point, the needle thread loops 60 are inclined at a specified angle relative to the direction Y of fabric movement.

Such a thread cutting device involves a problem that since it is simply of such arrangement that the thread catch member 50 is caused to move back and forth along the aforesaid straight line path $X_1$, the catch member 50 may sometimes fail to catch some needle thread loop or loops 60 when it turns back on the straight line path $X_1$, thus causing a loop catching error.

SUMMARY OF THE INVENTION

Accordingly, the aforsaid problem is solved by providing a thread cutting device which includes a cutter. a thread catch member having hook portions, and a support member pivotally and slidably supported on a machine bed and with which the thread catch member is slidably engageable only in a direction toward needle and looper thread loops. Unlike the well known arrangement such that the hook portion of the thread catch member which is caused to project into needle thread loops is movable back and forth in orthogonal relation to the direction of fabric feed, the present invention provides a thread cutting device in which the thread catch member is movable toward and away from needle thread and looper thread loops only after both the support member and the thread catch member are displaced with a pivot link connected to the support member so as to assure a specified tilted pose. While the support member is held in a specified tilted pose, the hook portions of the thread catch member move in linear fashion from a position at which they overlap the cutter to a projected position at which the hook portions seize the needle thread loops and looper thread loop. In this connection, the straight line path along which the hook portions travel is inclined at an angle of $\theta_1$ relative to the direction orthogonal to the direction of fabric feed during sewing operation. This angle of inclination $\theta_1$ is generally identical with the inclination angle $\theta_2$ at which the looper is inclined relative to aforesaid straight line path $X_1$. The thread catch member is moved in reverse, so that after the hook portion seize the needle thread and the looper thread loops they are cut by a trimming action of the hook portion and the cutter. Thereafter both the thread catch member and the support member remove into a standby position.

It is an object of the invention to provide a thread cutting device which is caused to project into and retreat from a plurality of needle thread loops in a more conveniently orthogonal relation to the plane of opening of the needle thread loops.

It is another object of the invention to provide means for assuring seizement of a plurality of needle thread loops as well as looper thread loop to ensure trimming of all the thread loops carried from the looper.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

One embodiment of the thread cutting device according to the invention will now be described as to the arrangement and functions thereof, with reference to FIGS. 1 to 9, inclusive, of the accompanying drawings.

Figure 1:
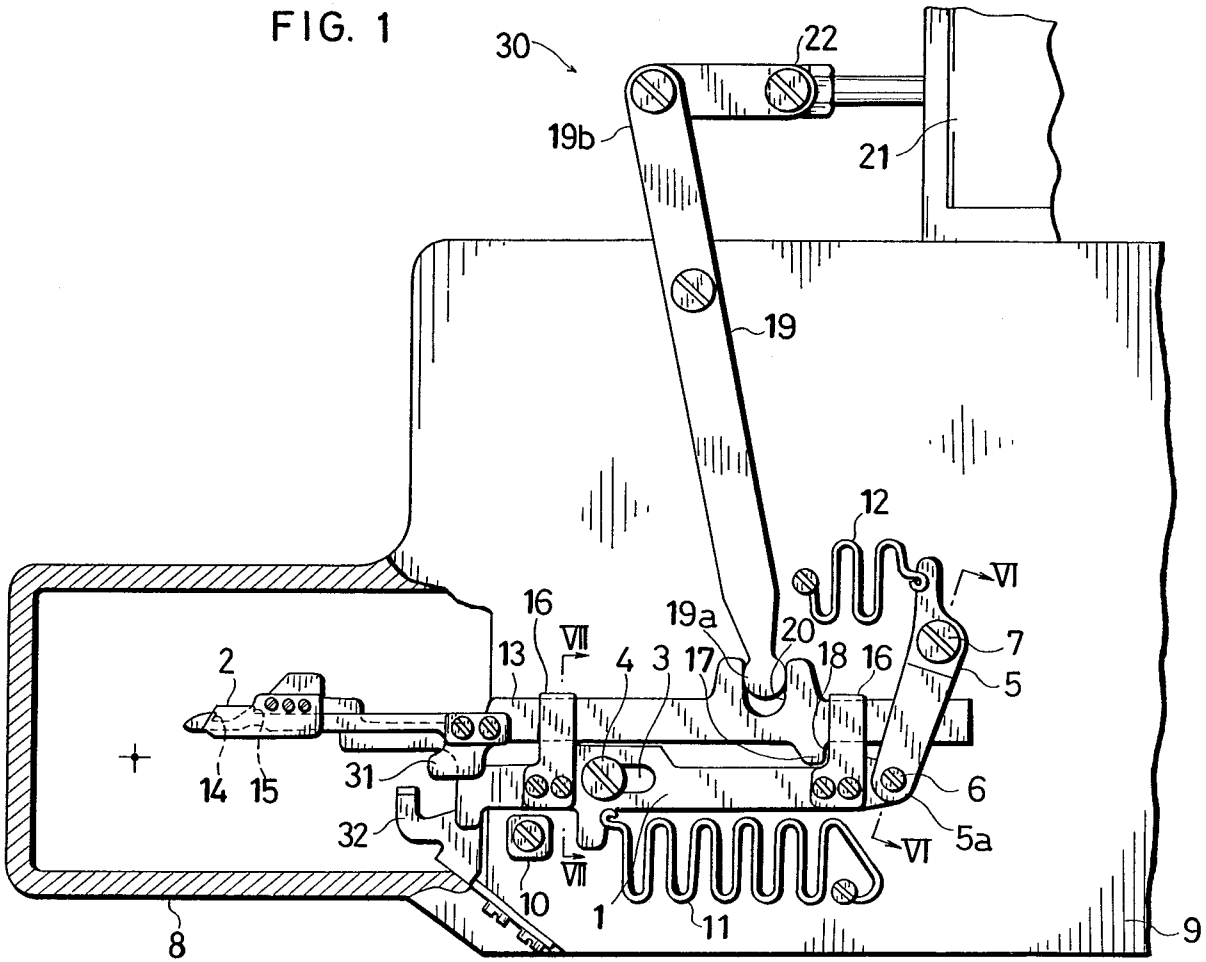
FIGS. 1 to 3, inclusive, are plan views, partially cutaway, showing a thread cutting device representing one embodiment of the invention.
Figure 2:
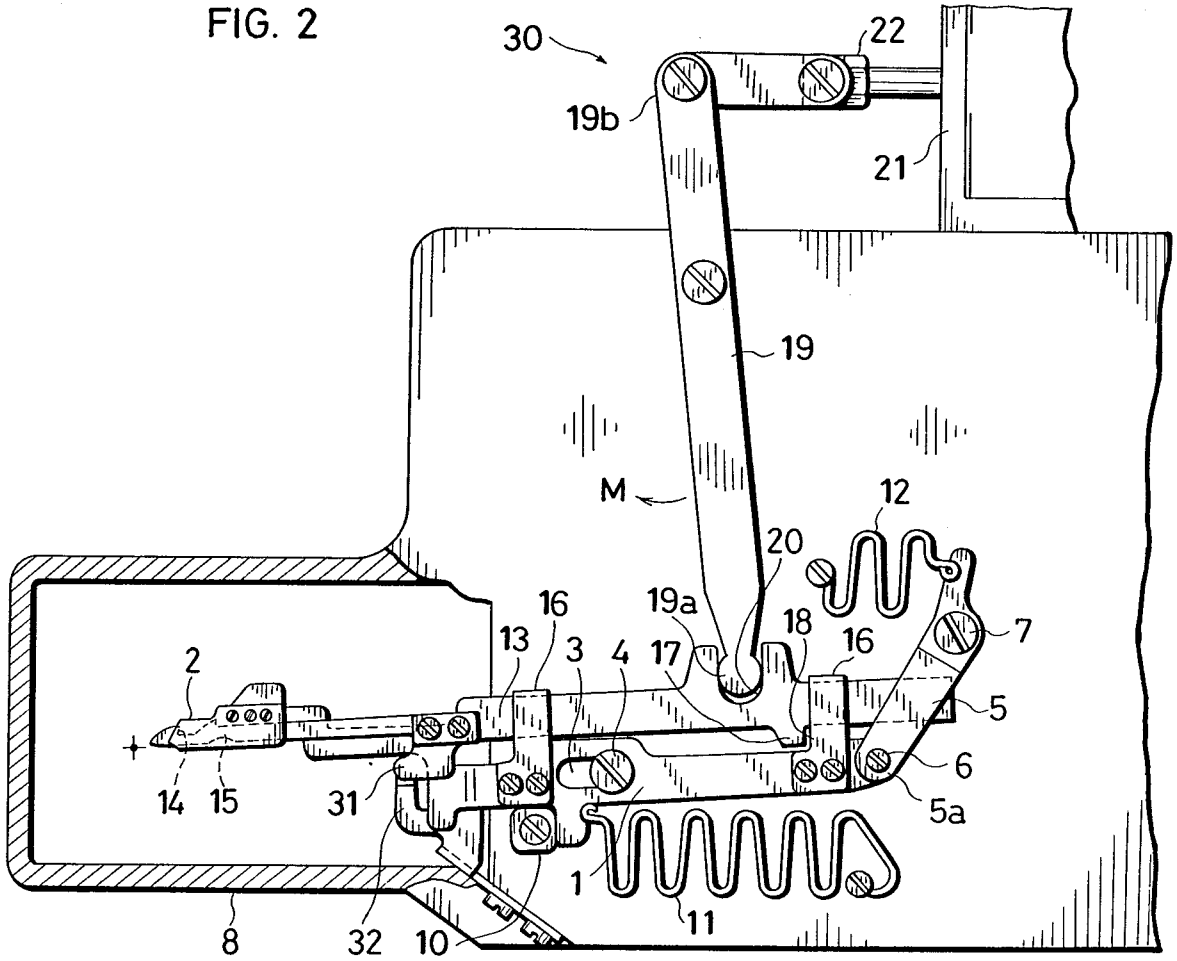
Figure 3:
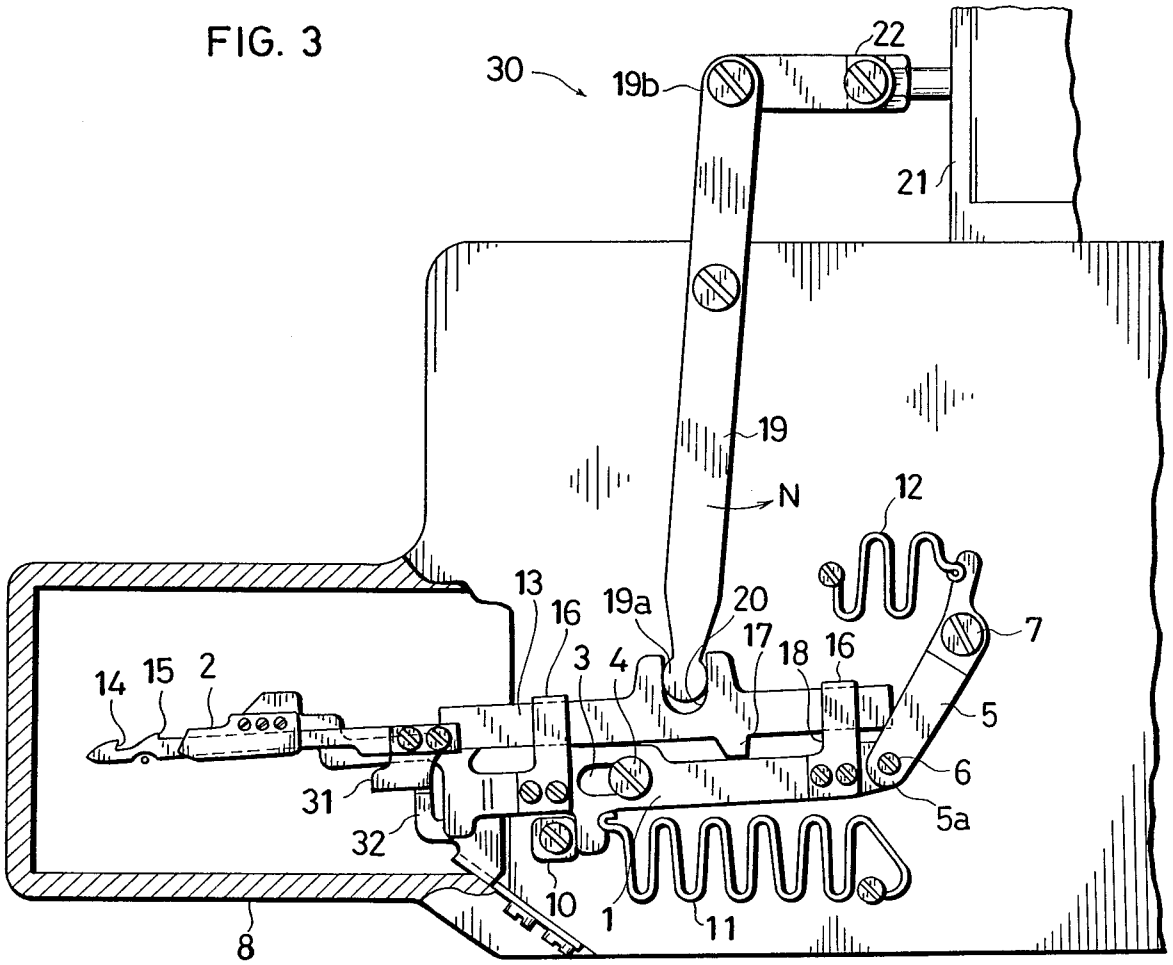

In FIGS. 1 through 3, numeral 1 designates a support member having a thread cutter 2 at the front end thereof and provided with a slot 3 at a suitable spot therein. In the slot 3 there is fitted a guide pin 4 consisting of a machine screw and the like, which is fixed to a machine bed. The rear end of the support member 1 is pivotably connected by a pin 6 to a free end 5*a* of a pivot link 5. Accordingly, the support member 1 is pivotally movable on the guide pin 4 between a standby position shown in FIG. 1 and an operative position shown in FIGS. 2 and 3 as it is guided by the pivot link 5. A support pin 7 by which the other end of the pivot link 5 is pivotally supported is secured to a mounting member 9 located on the bed 8 as shown in detail in FIG. 6. Numeral 10 designates a stopper member fixed to the mounting member 9, which engages the support member 1 to prevent it from moving toward needle and looper threads when the support member 1 is in the operative position as may be seen from FIGS. 2 and 3. Shown by 11, 12 are resilient means, each consisting of a springy material. The one resilient means 11 constantly urges the support member 1 to slide toward needle and looper thread loops, while the other resilient means 12 constantly exerts pressure on the pivot link 5 to urge its free end to turn toward the needle and looper thread loops.

Figure 4:
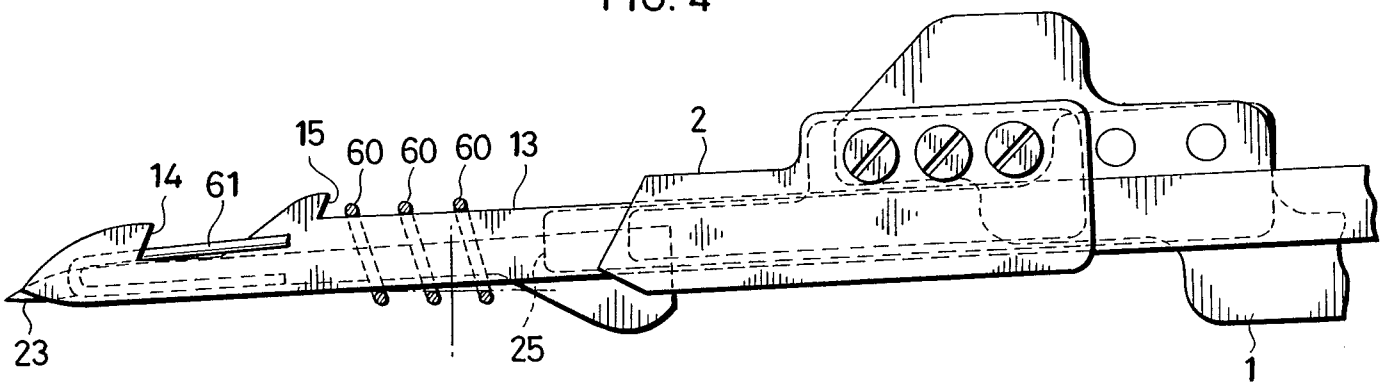
FIG. 4 is an enlarged plan view showing key portions of the device seen in FIG. 3.
Figure 5:
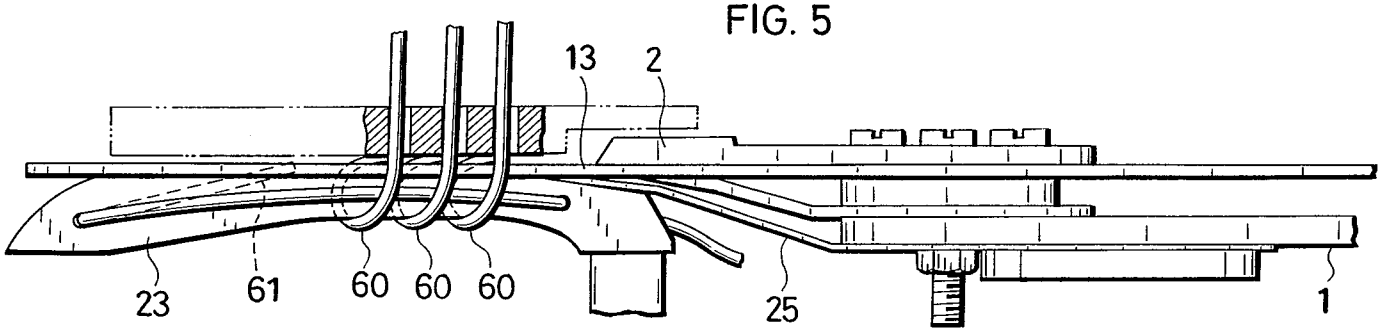
FIG. 5 is a partially cutaway side view corresponding to FIG. 4.
Figure 6:
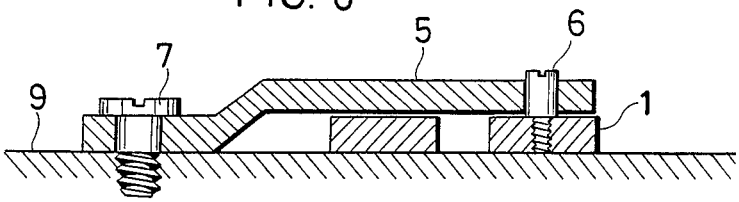
FIG. 6 is an enlarged section taken along line VI—VI in FIG. 1.
Figure 7:
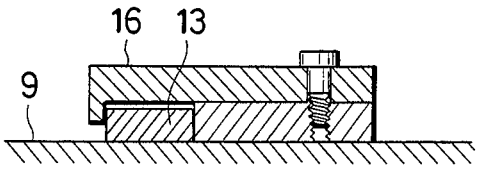
FIG. 7 is an enlarged section taken along line VII—VII in FIG. 1.

Numeral 13 designates a thread catch member having hook portions 14, 15 at two front end locations therein and held in engagement with guide members 16, 16, fixed to the support member 1, so that it is slidable only toward needle thread loop 60 and looper thread loops 61 (FIGS. 4 and 5). As FIG. 7 illustrates, the thread catch member 13 is slidable held between the each guide members 16 each and the mounting member 9. An engagement portion 17 of the thread catch member 13 is opposed to a stepped portion 18 of the support member 1. Accordingly, when the support member 1 under the force of the resilient means 11, 12 is pivotally moved between the standby position and the operative position, the stepped portion 18 is pressed against the engagement portion 17, so that the support member 1 is moved to follow the thread catch member 13.

Numeral 30 designates drive means for driving the thread catch member 13. The drive means include a drive lever 19 which is connected at its front end 19*a* to the thread catch member 13 through engagement of a front end 19*a* with a recess 20 formed in the catch member 13. The base end 19*b* of the drive lever 19 is connected through a connecting member 22 to a drive power source including a solenoid 21 or the like. Numeral 31 designates a slide piece mounted to the thread catch member 13 at a median portion thereof, which is adapted to be stopped by a guide piece 32 mounted to the machine bed when the thread catch member 13 is displaced to the operative position shown in FIG. 2 while being held in the specified tilted pose. When the thread catch member 13 alone is caused to move back and forth as FIG. 3 illustrates, the slide piece 31 goes in slide contact with the guide piece 32 to allow a smooth and accurate linear movement of the thread catch member 13 in the specified tilted pose.

Thus, when the drive power source 21 of the drive means 30 is actuated, the support member 1 strikes the stopper member 10 so that it is displaced to the operative position while being caused to assume the specified tilted pose as FIG. 2 shows; and then the lever 19 is pivotally moved in a forward direction shown by the arrow M, whereupon the thread catch member 13 is guided by the guide members 16, 16 into slide movement in conjunction with the guide piece 31 guided by the guide piece 32, so that the hook portions 14, 15 of the thread catch member 13 move in linear fashion from a position at which they overlap the cutter 2 to a projected position shown in FIG. 3. When the lever 19 is pivotally moved away from the FIG. 3 position thereof and in the reverse direction indicated by the arrow N, the thread catch member 13 is actuated to slide so that the hook portions 14, 15 are moved in reverse.

Figure 8:
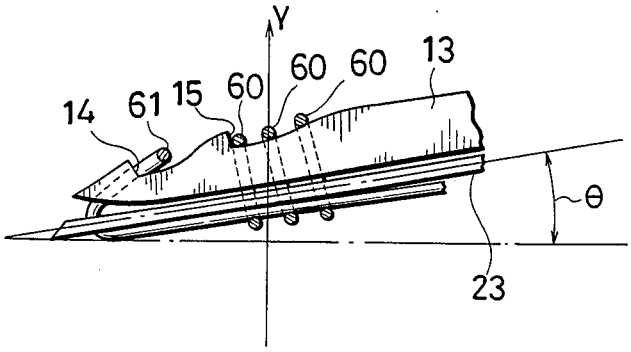
FIG. 8 is a fragmentary schematic view in plan illustrating the function of the thread cutting device.
Figure 9:
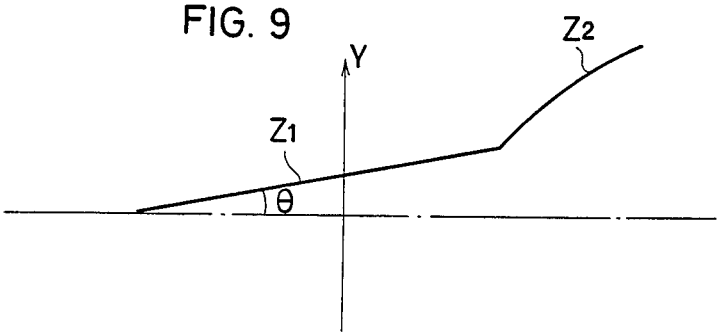
FIG. 9 is an explanatory view illustrating the path to be followed by hook portions of a thread catch member.
Figure 10:
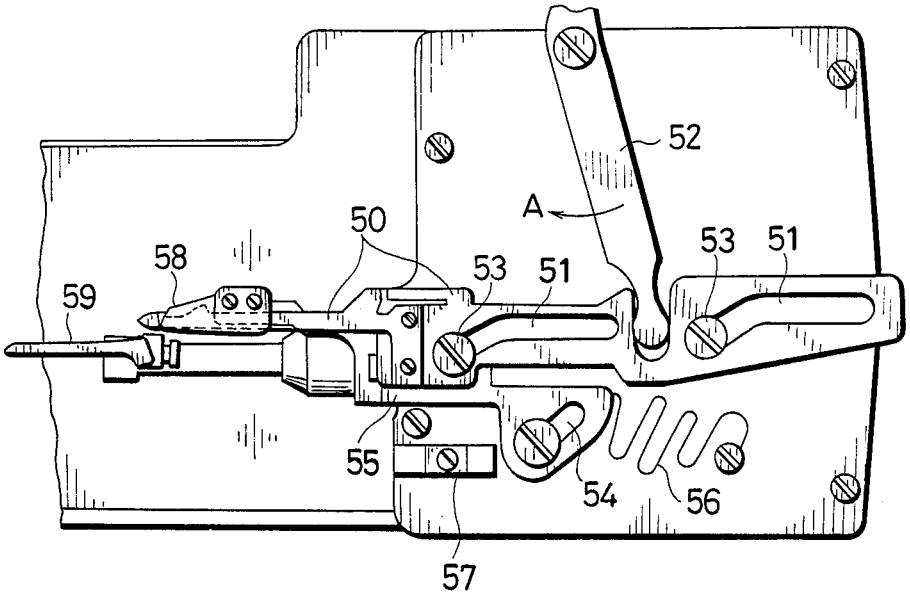
FIG. 10 PRIOR ART
FIG. 10 is a partially cutaway plan view showing a conventional thread cutting device.

In this connection it is noted that as FIGS. 8 and 9 illustrate, the straight line path $Z_1$ along which the hook portions 14, 15 travel is inclined at an angle of $\theta$ relative to the direction orthogonal to the direction Y of fabric feed during sewing operation. This angle of inclination $\theta$, as above mentioned, is generally identical with the inclination angle $\theta$ at which the looper 23 is inclined relative to the aforesaid straight line path $X_1$, which angle is set at approximately 3 degrees.

FIG. 4 is a plan view showing the thread catch member 13 as it appears when it plunges into a plurality of needle loops 60 and a looper loop 61 caught in the needle loops 60. FIG. 5 is a partially cutaway side view thereof. As can be clearly seen from these figures, when the thread catch member 13 moves to the projected position, the one hook portion 14 thereof plunges into the looper loop 61 and the other hook portion 15 plunges into the needle loops 60. As the thread catch member 13 slides back from the projected position so that the hook portions 14, 15 thereof reverses the straight line path $Z_1$ shown in FIG. 9, the hook portion 14 carries along the looper thread 61 caught thereinto and similarly the hook portion 15 carries along the needle threads 60 caught thereinto. Thus, the needle threads 60 are cut by the thread cutter 2, and then the looper thread 61 is cut likewise. As explained earlier with reference to FIG. 8, the straight line path $Z_1$ is inclined at an angle of $\theta$ relative to the direction orthogonal to the direction Y of fabric feed, and therefore the needle threads 60 . . . are caught into the hook portion 15 accurately and without any catching error. The cut end of the looper thread 61 continued from the thread supply is held in position between a fitting strip 25 shown in FIGS. 4, 5 and the thread catch member 13.

Figure 11:
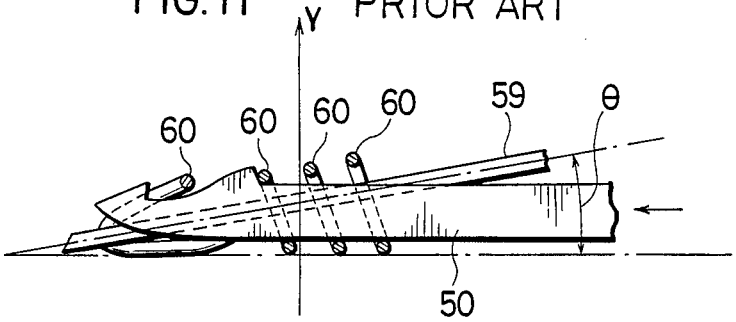
FIG. 11 PRIOR ART
FIG. 11 is a fragmentary schematic view in plan illustrating the function of the conventional thread cutting device.
Figure 12:
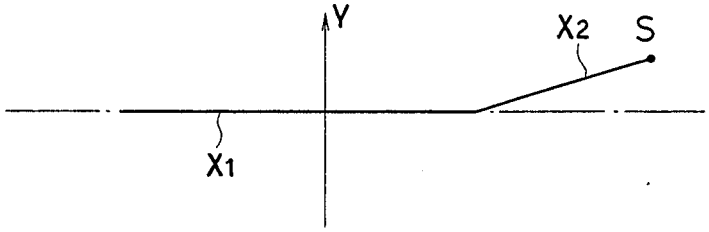
FIG. 12 PRIOR ART
FIG. 12 is an explanatory view illustrating the path to be followed by hook portions of a thread catch member in the conventional thread cutting device.

In a cylinder-type multi-needle sewing machine wherein a plurality of needle thread loops 60 are formed, as in the present instance, the needle loops 60 are slightly distorted in relation to the direction Y of thread feed as may be seen from FIGS. 4, 5 and 8, and the plane of opening of the individual needle loops (i.e., a plane defined by each needle loop) is slightly inclined relative to the direction Y of fabric feed. Therefore, by displacing the thread catch member 13, together with the support member 1, into the tilted pose by means of the pivot link, then causing the catch member 13 to move back and forth along the straight line path $Z_1$, the hook portions 14, 15 are caused to plunge into corresponding thread loops from a more orthogonal direction relative to aforesaid plane of opening, which fact assures more accurate plunging as compared with the case shown in FIG. 11 in which the hook portions plunge into the loops in oblique relation to the plane of opening. Furthermore, even if the needle thread loops 60 are somewhat irregularly distorted, the hook portions 14, 15 can be caused to plunge accurately into the loops 60 and to accurately catch the loops 60 as they reverse their path. Thus, erroneous catching possibilities may be effectively prevented.

When the support member 1 is pivotally moved by the lever 19 from the standby position to the operative position and vice versa, the thread catch member 13 is pivotally moved integrally with the support member 1. In this case, the path which the hook portions 14, 15 pass through is an arcuate path shown by $Z_2$ in FIG. 9. Therefore, when the support member 1 is in the standby position, both the thread catch member 13 and the support member 1 are positioned outside the path of movement of the looper 23 shown in FIGS. 4, 5 and 8, and thus they do not interfere with the movement of the looper 23.

In the above described embodiment, the support member 1 and the pivot link 12 are constantly urged by the biasing means 11 and 12 respectively so that the pivot link 12 is pivotally moved toward needle and looper thread loops and so that the support member 1 is caused to slide in the same direction. The invention is not limited to such arrangement. Depending upon the urging force of such biasing means, use of either one of the biasing means 11, 12 may achieve similar purposes.

What is claimed is:

1. A thread cutting device for a cylinder bed sewing machine which includes a cutter, and a thread catch member having hook portions at its front end for catching needle threads and a looper thread, the thread catch member being movable back and forth between a standby position at which it is positioned away from a path of movement of a looper and an operative position at which it is positioned close to the path of movement of the looper, the catch member being further movable back and forth to catch and cut by co-operation with the cutter by means of the hook portions thereof the thread at the operative position, said thread cutting device comprising:

a support member pivotally and slidably supported on a machine bed and with which said thread catch member is slidably engagable only in a direction toward needle thread loops, a pivot link connected pivotally at one end to the rear end of said support member and pivotally supported at the other end thereof on the machine bed, resilient means for constantly pressing at least one of said pivot link and said support member so as to allow said pivot link to be pivotally moved and said support member to slide toward the needle thread loops, and drive means for driving said thread catch member.

whereby as said thread catch member at said standby position is driven forward by said drive means to slide relative to said support member, said pivot link is pivotally moved toward said needle thread loops so that both said support member and said thread catch member are displaced from said standby position to said operative position while being caused to assume a predetermined tilted pose and whereby as said thread catch member is driven in reverse by said drive means, said pivot link is pivotally reversed against the pressing force of said resilient means so that both said support member and said thread catch member are displaced from said operative position to said standby position.

2. The thread cutting device for a cylinder bed sewing according to claim 1, wherein said support member has a slot formed at a suitable spot therein and wherein a guide pin secured to the machine bed is fitted in the slot

3. The thread cutting device for a cylinder bed sewing machine according to claim 1, wherein said support member has guide member fixed thereto and in which said thread catch member is slidably fitted.

4. The thread cutting device for a cylinder bed sewing machine according to claim 2, wherein said support member has guide members fixed thereto and in which said thread catch member is slidably fitted.

* * * * *

UNITED STATES PATENT AND TRADEMARK OFFICE

CERTIFICATE OF CORRECTION

PATENT NO. : 4,726,305

DATED : February 23, 1988

INVENTOR(S) : Yoji Seto

It is certified that error appears in the above-identified patent and that said Letters Patent is hereby corrected as shown below:

Claim 2, column 6, line 36, "machine" should be inserted between "ing" and "according"; and Claim 3, line 42, "a" should be inserted between "has" and "guide".

Signed and Sealed this

Ninth Day of August, 1988

*Attest:*

*Attesting Officer*

DONALD J. QUIGG

*Commissioner of Patents and Trademarks*